US005628955A

United States Patent [19]

Houk

[11] Patent Number: 5,628,955

[45] Date of Patent: May 13, 1997

[54] METHOD OF MANUFACTURE OF STRUCTURAL PRODUCTS

[76] Inventor: Edward E. Houk, 6106 Townhill, San Antonio, Tex. 78238-5033

[21] Appl. No.: 429,531

[22] Filed: Apr. 26, 1995

[51] Int. Cl.[6] ..... B28B 1/52; B28B 5/02

[52] U.S. Cl. ..... 264/426; 264/439; 264/440; 264/85; 264/108

[58] Field of Search ..... 264/426, 437, 264/438, 439, 440, 108, 85

[56] References Cited

U.S. PATENT DOCUMENTS

| | | | |
|---|---|---|---|
| 3,576,928 | 4/1971 | Burker et al. | 264/426 |
| 3,767,505 | 10/1973 | Coran et al. | 264/437 |
| 4,062,913 | 12/1977 | Miller et al. | 264/437 |
| 4,159,911 | 7/1979 | Takazuka | 264/426 |
| 5,057,253 | 10/1991 | Knoblach | 264/438 |
| 5,192,387 | 3/1993 | Buckley | 264/440 |

FOREIGN PATENT DOCUMENTS

| | | | |
|---|---|---|---|
| 1804201 | 5/1970 | Germany | 264/426 |
| 7228156 | 7/1972 | Japan | 264/437 |
| 1622122 | 1/1991 | U.S.S.R. | 264/426 |

*Primary Examiner*—Karen Aftergut

[57] ABSTRACT

A central supervisor controls a manufacturing process fabricating fibrous, cementitious structural products requiring very small dimensional tolerance, high strengths, controlled reinforcement alignments, multiple undercuts, and complex shapes not possible using casting, forming, or extrusion. The process uses electrical and magnetic fields to align and direct free floating, cement coated, magnetic, and nonmagnetic fibers, filaments, and elongated fragmented particles onto moving shaping devices. These devices have magnetized shaping tool surfaces to receive aligned materials in layers parallel, perpendicular, and angular to shaping surfaces. Controlled materials, cement, setting agents, magnetic fluxes, and electrical charges make possible better bonding of cements with materials and consolidation of nonplastic matrices. Sliding, and rotating shaping tools make multiple undercuts on faces and edges of the products. When the cement has set shaping tools are removed by pistons and rotors and products are detached from the shaping devices by magnetic force.

13 Claims, 2 Drawing Sheets

METHOD OF MANUFACTURE OF STRUCTURAL PRODUCTS

This invention relates to manufacture of fibrous, cementitious and clay products; a related invention, titled "Construction Components and Assembly System", as U.S. Application Ser. No. 08/438,806 makes use of this technology to obtain a very small tolerance necessary for that invention.

Casting, pressure molding and extruding have long been necessary for forming cementitious products. A very small tolerance is not possible using these methods without loss of other desirable attributes. Without sufficient plasticity, voids within the product result and an acceptable finish can not be accomplished with today's molding, casting and extrusion technology. Use of flammable resinous materials is not a viable alternative even though an insulated, fire resistant cover is applied, due to resulting bonding and insurance problems.

However, reduction in strength and loss of accuracy resulting from excess moisture or molding pressure can be overcome by the sapient use of electrical and magnetic forces. An acceptable finish, fiber alignment and a dimensionally accurate, stable and strong product can be fabricated from nonplastic cementitious materials by use of this technology. Other problems such as equipment wear due to abrasion, and adhesion of cementitious material to the mixing container can also be avoided.

Unrestrained rod shapes such as fibers, and elongated fragmented particle, and filaments containing graphite, carbon and, or iron will readily align with iron rods when passing through a weak magnetic field. Other moisture coated rod shapes of materials will also react in the same manner. Aggregates in fragment form will form clusters with sharp edges in contact and nearly parallel peripheral surfaces. Moreover, when attracted to magnetized surfaces, these rod and fragmented shapes will remain aligned and will adhere closely to the magnetic surface; thereby allowing spaces and voids to be eliminated. Cement and color filaments will also be attracted to a magnetized surface to provide an acceptable finish. Consolidation may follow for successive layers of fibrous and fragmented media. The resulting nonplastic matrix will set and cure to form a dimensionally accurate, stable and strong product.

The process begins by moving materials from storage vats. Controlled weights, electrical charge and magnetic force must be maintained throughout all processes and steps. A supervisory control center is required for not only these processes but also for coating, flow, alignment and depositing of fibers, as well as movement of a shaping device and shaping tools. Fibers must be separated and impressed with a charge prior to coating in order to assure that cement is in contact with all surfaces. By adding a wetting agent to control the surface tension of the setting agent, and by controlling the amount of setting agent, sufficient agent can be applied to cause the cement to set while excessive setting material can be avoided which would result in a poor quality product. If flammable cements and catalysts are used, inert gasses should be used to purge oxygen from the environment in order to prevent ignition. Premixed cement and fibers, now readily available in most markets, may be used, but coating and aligning are more difficult. Aqueous solutions, when used as a catalytic agent, will facilitate alignment due to electrical flow along surfaces. Although the setting agent may be added to the fibers after alignment, the preferred method is to insert it before alignment to prevent fiber displacement during the coating action. Coating of fibers with a setting material containing a wetting agent prior to adding cement is a convenient way to ensure against excessive setting material. Other agents such as those effecting air entrainment, hardening and bonding may be added to the setting material to improve product characteristics. An air blower of the squirrel cage type is used to force cement toward fibers and into a thin sheet in the coating step. Providing an electrical charge to the mixing and aligning device will enhance the process to prevent premature adherence of the cementitious material to the container since the repelling magnetic force is very small.

After the coating step, the cement, a setting and solidifying agent, (aqueous or resin materials), and fibers, will be directed in a thin sheet, flowing through a magnetic field modified by a grid of parallel magnetized rods carrying an electrical current (supervised by the control center) to align fibers and filaments in direction and plane. The grid should be controllable to allow rotation around a vertical as well as horizontal axis. The magnetic field may be created by permanent magnets and/or electromagnets. Fiber direction may be rotated or otherwise changed by moving the aligning rods about vertical as well as horizontal axes. The electrical flow and magnetic field may be very small during this alignment step. Excessive current will result in small holes in the shaped product. The controlled, aligned and coated fibers should then be passed to a shaping device containing attracting magnetized iron surfaces. A pushing magnetic force field will be required at the discharge with the field directed parallel with the media flow for nonmagnetic fibers and cement. However, it should be noted that most hydraulic cements, other than white cement, contain sufficient iron oxides to be considered magnetic for this invention, while resinous cements may, or may not, contain sufficient iron oxides.

After the fibers are aligned in a thin sheet, either parallel or perpendicular or angular relative to a primary face of the product, fibers are attracted to surfaces defining the product. Multiple layers are deposited and consolidated until the desired shape is reached. Products having undercuts made by shaping tools where the attracting surfaces are not facing the flow of fibers, must be shaped by increasing the magnetic attracting force of that surface until all cavities are filled. The fiber and cement mixture is not plastic, therefore present technologies are not applicable. However, all cavities are now filled; voids have been avoided; and contact with the shaping surfaces assures satisfactory finish surfaces. When the shaping stage is completed, the shaping device is moved to accomplish initial set.

When initial set is completed, poles of the attracting magnetized tool surfaces shall be changed, obstructing shaping tools shall be removed, and the product shall be released and moved to final curing. All processes, movements, weights, electrical circuits, and magnetic fields must be supervised by a central control from bulk storage vats to final curing. In summary, by sequence, from storage vat to product storage; the following steps apply: moving and weighing material, impressing electrical charge and magnetic field, separating fibers, coating fibers with setting agent and cement, aligning fibers, depositing fibers on shaping tool surfaces, application of layers until the shape is completed, accomplishing initial set, reversing poles, removing tools, removing product.

Materials used for the various components of this invention will be selected from available commercial products. Selection of specific materials must be flexible to adjust for market conditions, availability of new fiber products, and local codes. Some high strength fibers are damaged by caustic cements. When the alkalinity of the cement is within the acceptable range for the fiber to avoid permanent damage, and bonding between the fiber and the cement occurs, fibers and cements are referred to as being compatible.

Materials are described by generic nomenclature; since commercially available products differ in physical characteristics, each product must be tested to ensure alkalinity and bonding compatibility with other products.

Cementitious materials in particulate form include hydraulic cements such as low alkalinity Portland, pozzolana, and calcium aluminate cements; resinous cements such as heat, moisture and catalytic curing cements; fireclays, kaolin, low alumina clays, gypsum; aggregate materials contained within referenced cementitious materials include basalt, volcanic, other igneous, terra-cotta, and hard clay materials. Resinous cementitious material should be enclosed in hydraulic cementitious or gypsum covers. Catalyists to effect solidifying and bonding include chemical additives and agents to effect desired wetting characteristics, improve bonding and elasticity, air entrainment. Additives and agents will be in aqueous, resinous, and latex forms.

DETAIL DESCRIPTION OF THE DRAWINGS

Figure 1:
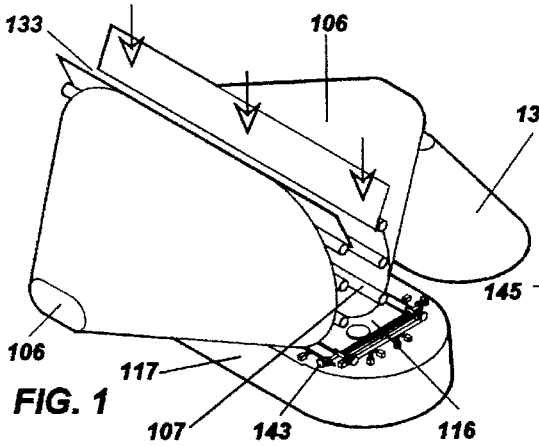
FIG. 1 is a schematic view of alignment and consolidation elements.
Figure 3:
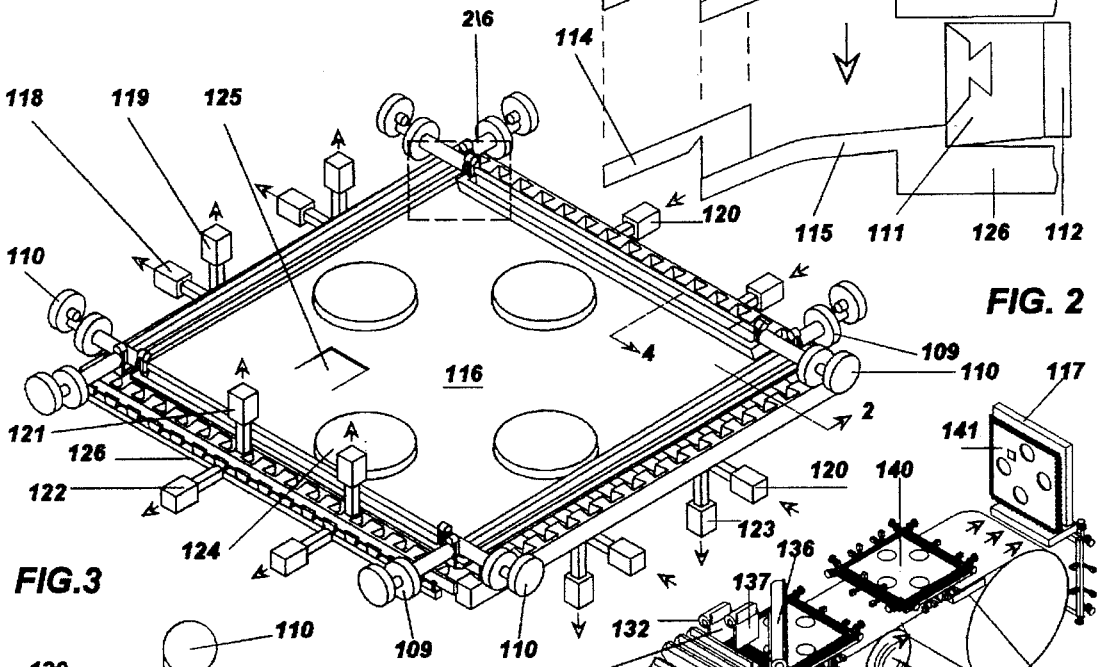
FIG. 3 shows a more detailed view of the shaping device in FIG. 1 and FIG. 5 ready for placing fibrous media upon attracting magnetic surfaces.
Figure 4:
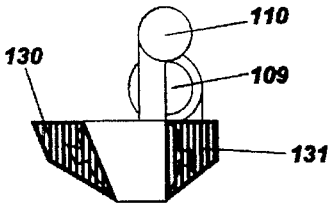
FIG. 4 shows a partial sectional view of magnetic surfaces to form shapes on the surfaces of the shaping device.
Figure 5:
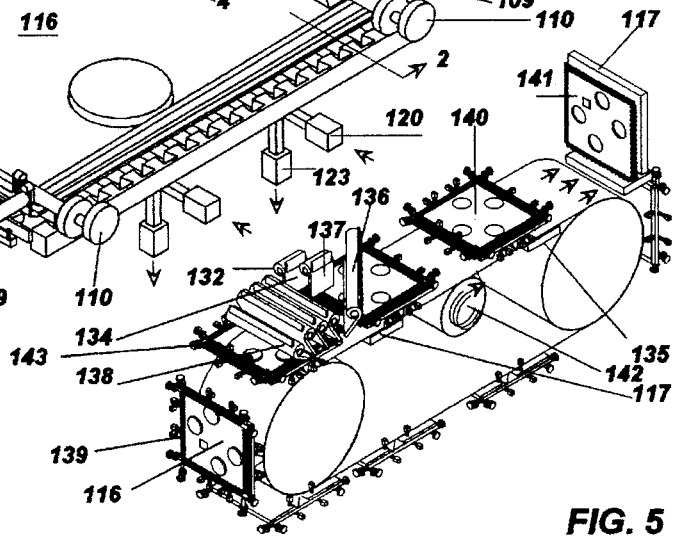
FIG. 5 shows a schematic view of a rotating assembly to move the shaping device.
Figure 6:
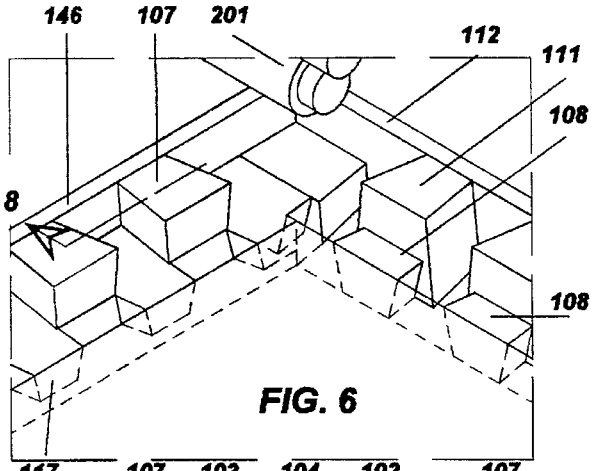
FIG. 6 is a corner detail from FIG. 3 with elevated rotors after discharging material showing shaping tools.
Figure 7:
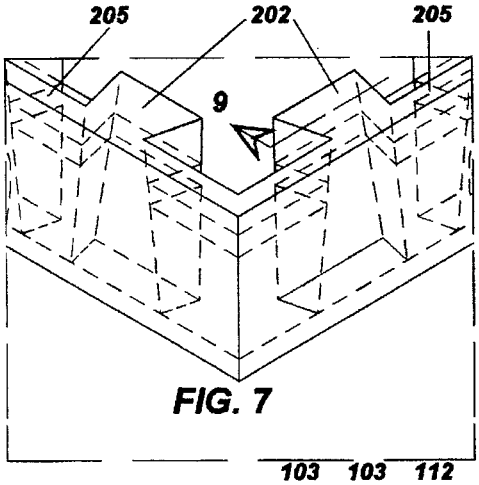
FIG. 7 is a corner detail of FIG. 10 showing shaping tools.

Fibers and filaments must be prepared for mixing by separating and coating each with a setting agent to attract cement introduced in a mixing chamber and forced into a thin sheet. The flow of the thin sheet may be traced from the stack throat at 133 in FIG. 1 past magnetizable rods 107 between opposing magnets 106 with like poles in close proximity. The magnet flux may be small from the two surfaces of similar charge. The rods will be attached to the repelling poles and to like electrical poles. Since the rods are in close proximity, media fibers will be forced into a line parallel to the rods and into a plane midway between them. Premature adherence to the containing chute may be avoided by electrical fields. After passing this step the media is deposited upon attracting magnetic surfaces of the shaping device indicated at 143 in FIG. 1 also shown in FIG. 3 and FIG. 5. The attracting flux is generated by magnets at 117. Consolidation is enhanced by the magnet at 135 which provides the greatest flux generated. The field should be directed parallel with the flow. In FIG. 5, the shaping device detailed in FIG. 3 is continuously cycled through the material deposit and shaping, initial cure, separation, and return. Fibers and filaments are piped into the top of the aligning device at 132; and cement (or clay) dust coat the fibers and filaments. They are forced through the stack throat in a thin sheet at 133 into the alignment stack at 134. The repelling magnet, 135, is located at the end of each stack. A diagonal alignment stack is indicated at 136; longitudinal stacks, parallel to shaping device movement, are at 137 and transverse stacks are at 138. The empty shaping device is returned for use at 139; initial set is accomplished at 140 and the shaped product has been separated from the shaping apparatus at 141 and is being moved into final curing ovens.

The multiple stacks shown at 138 carry various mixtures of cements, fibers, filaments, clays, and aggregates depending on the use, market price and location. Repelling electromagnets 135 will be located at the downstream side of each stack discharge. Electromagnets schematically indicated at 117 are attracting magnets, while those at 106, and 135 are repelling magnets. The drive wheel is shown at 142. While equipment in differing rotated alignments at 132 through 138 is always connected to a positive electrical pole, the negative pole for attracting surfaces must change after initial set.

Figure 2:
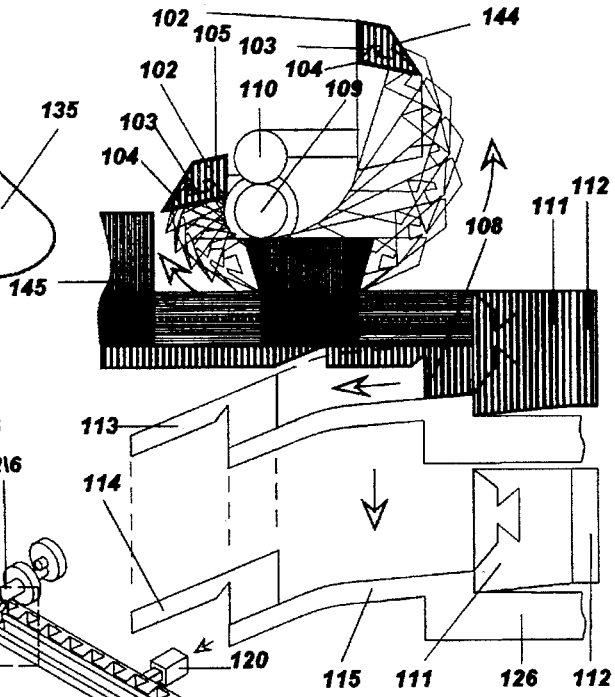
FIG. 2 is a detail sectional view from FIG. 3 to show movement of shaping tools necessary for product release. The release of the product from the shaping device is a major constraint.

Shaping tools represented at 105 and 144 in FIG. 2 are moved by hydraulic rotors, 109 and 110. Pistons 118 through 123 are also necessary in order to release the product after initial set. All tools are made up of two parts; anodes (connected to repelling pole and electrical current) are illustrated at 102 and cathodes (connected to attracting pole and electrical current) at 104, separated by electric insulators at 103. All tools and connectors are comprised of anodes, cathodes, and insulators; even though not specifically illustrated or called out hereafter. Cathodes will change poles and electrical charge while the anode will always be the same. Space has been provided to avoid conflicts between tools and product parts. Tool 108 with its attached leg must be moved to the left by piston 120 without rotation until it is under the base, 116, at the position 113. It can then be moved downward along with tools 111 and connectors 112, 115, 126 and 146 to position 114. Tools at 124 shape ventilation holes. A small indentation in the base 116 is at the position 125. Fiber alignment is shown at 145.

Figure 8:
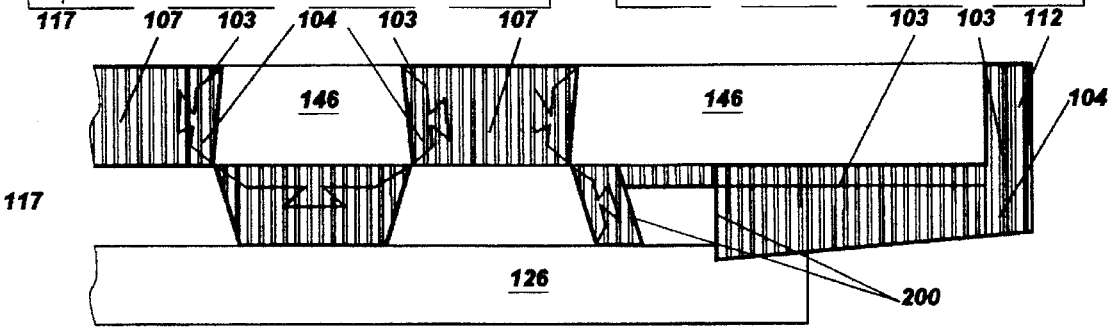
FIG. 8 is a sectional view of the shaping tools detailed in FIG. 6.
Figure 9:
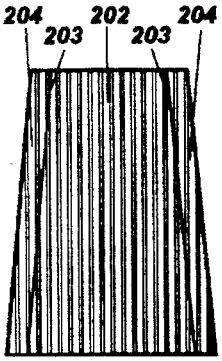
FIG. 9 details a sectional view of shaping tools shown in FIG. 7.
Figure 10:
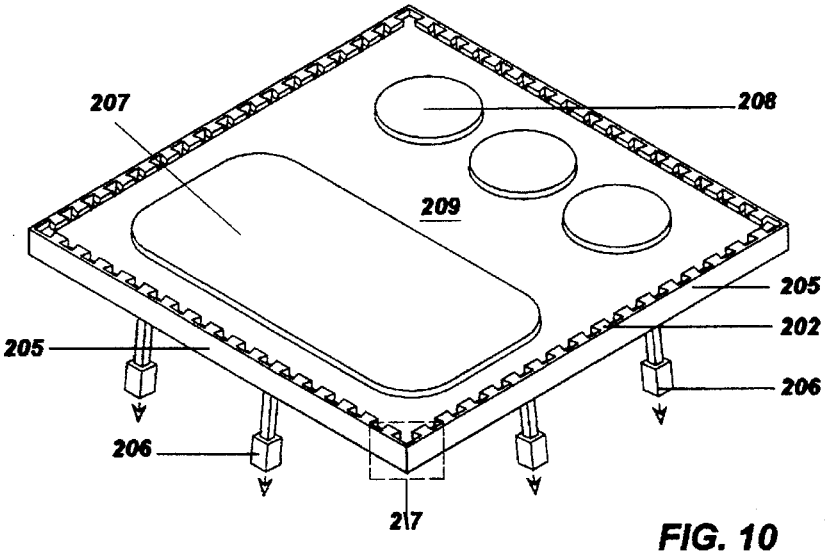
FIG. 10 contains a view of a second shaping device.

Sheet Two shows additional details from Sheet One along with the shaping device for another product. A transverse section through tools 107 (this sheet only) is also indicated in FIG. 8. End blocks are necessary at corners shown at 200. Position 201 indicates the rotor tools elevated in the manufacturing sequence after product separation. Shaping tools are best viewed at this point. In FIG. 9 the anode 202, the magnetized surfacing material also carrying an electrical current, is separated from cathode 204, carrying opposite charge and pole, by insulation 203; while 205 connects the tools to the pistons 206 in FIG. 10. Holes are formed by 207 and 208 penetrating the base cathode 209.

Any part of this Specification and claim found objectionable may be severed and the remainder shall remain intact. I declare that my intended application is valid without such severed part.

I claim:

1. A method of fabricating a product by setting of a cementitious mixture consisting of fibers, setting agents, and cement, comprising the steps of:

(a) coating said fibers with setting agents and cement in optimum amounts to effect setting of said cementitious mixture at a selected time to produce a strong product without shrinkage after setting thereof;

(b) forcing said fibers coated with setting agents and cement into a downwardly directed sheet flow;

(c) applying opposing, repelling magnetic fields to said sheet flow of said fibers coated with setting agents and cement;

(d) providing grids of electrically conductive and magnetizable rods in proximity of said sheet flow of said fibers coated with setting agents and cement;

(e) aligning fibers by passing said sheet flow of said fibers coated with setting agents and cement between said grids of electrically conductive and magnetizable rods and said magnetic fields to effect alignments of said fibers coated with setting agents and cement conforming with said grids of electrically conductive and magnetizable rods;

(f) providing a shaping device having attracting magnetized surfaces corresponding to said product;

(g) moving said shaping device horizontally through said sheet flow of said fibers coated with setting agents and cement while depositing layers of said fibers coated with setting agents and cement upon said attracting magnetized surfaces in continuous layers while maintaining alignments of said fibers as provided here before in step (e) of aligning fibers;

(h) and permitting said cementitious mixture to set into solid form.

2. The method of claim 1 further providing storage vats, chutes, permanent magnets, air blowers, and a central control center supervising movements, weights, electrical charges, magnetic forces, steps defined herein, wherein the step (a) of mixing said fibers, setting agents, and cement is further defined as:

(a1)moving each of said fibers, setting agents, and cement from said storage vats to said chutes for each of said fibers, setting agents, and cement while weighing each thereof;

(a2) applying a first electrical charge to said fibers;

(a3) introducing a repelling magnetic field by said permanent magnets to said fibers to effect separation thereof;

(a4) introducing a second electrical charge, opposite to said first electrical charge, to said fibers;

(a5) coating said fibers with said setting agents;

(a6) and applying said cement by said blowers to said fibers wherein each fiber is coated with said setting agents and cement in optimum amounts to effect setting of said cementitious mixture at a selected time to produce a strong product without shrinkage after setting thereof.

3. The method of claim 1 wherein step (g) of moving said shaping device horizontally through said sheet flow of said fibers, setting agents, and cement is further defined as:

(g1) selecting fiber alignments by rotating sheet flows of said fibers, setting agents, and cement about vertical and horizontal axes while rotating said grids of electrically conductive and magnetizable rods about a horizontal axis;

(g2) passing said sheet flows of said fibers, setting agents, and cement between said grids of electrically conductive and magnetizable rods and said magnetic fields to effect alignments of said fibers conforming with said grids of electrically conductive and magnetizable rods for each rotation thereof;

(g3) and moving said shaping device through said sheet flows of said fibers coated with setting agents and cement for each rotation thereof while depositing layers of said fibers coated with setting agents and cement upon selected said attracting magnetized surfaces in continuous layers, wherein said fibers are maintained in alignments conforming with said grids of electrically conductive and magnetizable rods in step (g1) of selecting fiber alignments, and wherein the said product is completed.

4. The method of claim 1 further includes attaching an electrical insulating material and a backing consisting of conductive and magnetizable material to a backside of each of said shaping tool surfaces, said backing having repelling surfaces, wherein spillover over of said sheet flows of said fibers, setting agents, and cement is limited and edges are cleanly terminated.

5. The method of fabricating structural products resulting from setting of a cementitious mixture consisting of fiber and filament materials, fragmented aggregates, setting agents and cement by providing storage vats for each of said fiber and filament materials, fragmented aggregates, setting agents and cement, by providing moving equipment, weighing equipment, chutes, air blowers, mixing containers and alignment stacks having surfaces with repelling electrical charges and magnetic fields, permanent magnets, electromagnets, grids of electrically conductive and magnetizable rods for each of said fiber and filament materials and fragmented aggregates, by providing shaping devices having electrically conductive and magnetizable shaping tool, base and connector surfaces corresponding to surfaces of said structural products, and a central control center supervising the following steps:

(a) moving each of said fiber and filament materials, fragmented aggregates, setting agents and cement from said storage vats to separate said chutes for each of said fiber and filament materials, fragmented aggregates, setting agents and cement while weighing each thereof;

(b) applying a first electrical charge to said fiber and filament materials, and said fragmented aggregates in separate said chutes;

(c) separately introducing a repelling magnetic field by said permanent magnets to said fiber and filament materials, and said fragmented aggregates, to effect separation thereof;

(d) separately introducing a second electrical charge, opposite to said first electrical charge, to said fiber and filament materials, and fragmented aggregates;

(e) separately coating said fiber and filament materials, and said fragmented aggregates, with optimum amounts of said setting agents, wherein setting occurs at a selected time while effecting a strong product without shrinkage thereof;

(f) separately applying air blowers to said fiber and filament materials, and said fragmented aggregates;

(g) mixing said fiber and filament materials, and said fragmented aggregates coated with said setting agents with said cement in separate said mixing containers having said surfaces with repelling electrical charges and magnetic fields by said air blowers; wherein each fiber, each filament and each fragmented aggregate particle is coated with setting agent and cement;

(h) forcing said fiber and filament materials, and said fragmented aggregates coated with said setting agents and cement within narrow sheet flows of said fiber and filament materials, and said fragmented aggregates coated with said setting agents and cement into separate said alignment stacks having surfaces with repelling electrical charges and magnetic fields, wherein said sheet flows of said fiber and filament materials, and said fragmented aggregates coated with said setting agents and cement are directed toward and perpendicular to said electrically conductive and magnetizable shaping tool, base and connector surfaces of said shaping devices;

(i) aligning fibers, filaments, and aggregate particles by separately directing said sheet flows of said fiber and filament materials, and fragmented aggregates coated with said setting agents and cement between said grids of electrically conductive and magnetizable rods while applying a magnetic field, wherein said each fiber, each filament and each aggregate particle is aligned with said grids of electrically conductive and magnetizable rods;

(j) discharging separately said sheet flows of said fiber and filament materials, and said fragmented aggregates coated with said setting agents and cement passed said electromagnet directing a repelling magnetic field parallel to said flows of said fiber and filament materials, and said fragmented aggregates coated with said setting agents and cement, and toward said electrically conductive and magnetizable shaping tool, base and connector surfaces of said shaping devices;

(k) applying an attracting magnetic field to said electrically conductive and magnetizable shaping tool, base and connector surfaces of said shaping devices;

(l) moving said shaping devices across discharged said sheet flows of said fiber and filament materials coated with said setting agents and cement to effect depositing of continuous consolidated layers of said fiber and filament materials coated with said setting agents and cement upon said electrically conductive and magnetizable shaping tool, base, and connector surfaces having attracting magnetic fields wherein alignments provided here before in step (i) of aligning fibers, filaments, and aggregate particles are maintained;

(m) selecting alignments by rotating said alignment stacks having surfaces with repelling electrical charges and magnetic fields and said sheet flows of said fiber and filament materials coated with setting agents and cement to selected alignments around vertical and horizontal axes while rotating said grids of electrically conductive and magnetizable rods to selected alignments around horizontal axes, and further including repeating the steps here before provided in first step (a) through step (l) of moving said shaping devices for each rotation of said alignment stacks having surfaces with repelling electrical charges and magnetic fields and for each rotation of said grids of electrically conductive and magnetizable rods, wherein said fiber and filament materials coated with said setting agents and cement are deposited in parallel, perpendicular and angular layers with respect to said tool, base and connector surfaces of said shaping devices;

(n) moving said shaping devices across discharged said sheet flows of said fragmented aggregates coated with said setting agents and cement to effect depositing of continuous consolidated layers of said fragmented aggregates coated with said setting agents and cement upon said electrically conductive and magnetizable shaping tool, base, and connector surfaces having attracting magnetic fields wherein alignments of said fragmented aggregates are maintained as provided in step (m) of selecting alignments;

(o) applying successive layers of said sheet flows of said fiber and filament materials coated with said setting agents and cements, thereby achieving essential selected shape of said structural products;

(p) effecting initial setting of said cementitious mixture to form said structural products.

(q) reversing poles of said attracting magnetic fields of said shaping tool, base and connector surfaces, thereby effecting release of said structural products from said shaping tool, base and connector surfaces;

(r) rotating and removing shaping tools and connectors from said shaping device;

(s) applying repelling magnetic forces by said electromagnets thereby forcing said structural products from said shaping devices;

(t) and relocating said structural products to effect final curing thereof, thereby achieving essential structural attributes of said structural products.

6. The method of claim 5 further includes attaching an electrical insulating material and a backing consisting of electrically conductive and magnetizable material to a backside of each of said shaping tool and connector surfaces, said backing having repelling surfaces, wherein spill over of said sheet flow is reduced and product corners are improved.

7. The method of claim 1 wherein said cement is selected from the group consisting of: low alkalinity Portland cement, pozzolana cement, calcium aluminate cement, gypsum cements, resinous cements; and wherein at least one of said fibers is selected from the group consisting of: barium fibers, barium filaments, carbon fibers, carbon filaments, alkaline resistant glass fibers, alkaline resistant glass filaments, zirconium silicate glass fibers, zirconium silicate glass filaments, metallic fibers, metallic filaments, graphite fibers, graphite filaments, ferrous fibers, ferrous filaments, hydrocarbon fibers, hydrocarbon filaments, polypropylene fibers, polypropylene filaments, natural fibers, and natural filaments.

8. The method of claim 1 wherein said cement is selected from the group consisting of: high alumina fireclay, kaolin clay, low alumina clay, and wherein at least one of said fibers is selected from the group consisting of: barium fibers, barium filaments, carbon fibers, carbon filaments, graphite fibers, and graphite filaments.

9. The method of claim 1 wherein said cement is a resinous hydrocarbon material, and wherein one activating agent is selected from the group consisting of: catalytic setting agents, thermal setting agents, hardening agents, and moisture setting agents, and wherein at least one of said fibers is selected from the group consisting of: barium fibers, barium filaments, carbon fibers, carbon filaments, alkaline resistant glass fibers, alkaline resistant glass filaments, zirconium silicate glass fibers, zirconium silicate glass filaments, graphite fibers, graphite filaments, hydrocarbon fibers, hydrocarbon filaments, polypropylene fibers, polypropylene filaments, metallic fibers, metallic filaments, natural fibers, natural filaments, and further providing mixing, aligning and depositing steps which are accomplished in an atmosphere of inert gases.

10. The method of claim 5 wherein said cement is selected from the group consisting of: low alkalinity Portland cement, pozzolana cement, calcium aluminate cement, gypsum cement, resinous cement; and wherein at least one of said fiber and filament materials is selected from the group consisting of: barium fibers, barium filaments, carbon fibers, carbon filaments, alkaline resistant glass fibers, alkaline resistant glass filaments, zirconium silicate glass fibers, zirconium silicate glass filaments, metallic fibers, metallic filaments, graphite fibers, graphite filaments, ferrous fibers, ferrous filaments, hydrocarbon fibers, hydrocarbon filaments, polypropylene fibers, polypropylene filaments, natural fibers, and natural filaments.

11. The method of claim 5 wherein said cement is selected from the group consisting of: high alumina fireclay, kaolin clay, low alumina clay, and wherein at least one of said fiber and filament materials is selected from the group consisting of: barium fibers, barium filaments, carbon fibers, carbon filaments, graphite fibers, and graphite filaments.

12. The method of claim 5 wherein said cement is a resinous hydrocarbon material, and wherein one activating agent is selected from the group consisting of: catalytic setting agents, thermal setting agents, hardening agents, and moisture setting agents, and wherein at least one of said fiber and filament materials is selected from the group consisting of: barium fibers, barium filaments, carbon fibers, carbon filaments, alkaline resistant glass fibers, alkaline resistant glass filaments, zirconium silicate glass fibers, zirconium silicate glass filaments, graphite fibers, graphite filaments, hydrocarbon fibers, hydrocarbon filaments, polypropylene fibers, polypropylene filaments, metallic fibers, metallic filaments, natural fibers, natural filaments, and further providing coating, mixing, aligning and depositing steps which are accomplished in an atmosphere of inert gases.

13. The method of claim 5 wherein said fragmented aggregates are selected from the group consisting of: basalt rock, gabbro rock, volcanic rock, igneous rock, terra-cotta clay material, and hard clay materials.

* * * * *